US006199332B1

(12) United States Patent
Ellson

(10) Patent No.: US 6,199,332 B1
(45) Date of Patent: Mar. 13, 2001

(54) LOG FACADE

(76) Inventor: Randall W. Ellson, 16721 Keasy Rd., Vernonia, OR (US) 97064

( * ) Notice: Subject to any disclaimer, the term of this patent is extended or adjusted under 35 U.S.C. 154(b) by 0 days.

(21) Appl. No.: 09/137,558

(22) Filed: Aug. 20, 1998

(51) Int. Cl.[7] ..... E04B 2/70
(52) U.S. Cl. ..... 52/233; 52/286; 52/748.11
(58) Field of Search ..... 52/233, 286, 311.2, 52/748.11

(56) References Cited

U.S. PATENT DOCUMENTS

| | | | | |
|---|---|---|---|---|
| 1,813,455 | | 7/1931 | Lawton . | |
| 2,110,787 | * | 3/1938 | Brandjord | 52/233 |
| 2,525,659 | | 10/1950 | Edson et al. . | |
| 3,863,409 | | 2/1975 | Fell . | |
| 4,012,876 | | 3/1977 | Grubbs . | |
| 4,056,906 | | 11/1977 | Elfstrom . | |
| 4,096,674 | | 6/1978 | Kollar et al. . | |
| 4,277,925 | | 7/1981 | Kinser . | |
| 4,288,954 | | 9/1981 | O'Donnell . | |
| 4,312,161 | | 1/1982 | Goldade . | |
| 4,320,610 | * | 3/1982 | Rupp | 52/233 |
| 4,429,550 | | 2/1984 | Farmont . | |
| 4,503,647 | | 3/1985 | Post . | |
| 4,592,182 | | 6/1986 | Felser . | |
| 4,627,204 | * | 12/1986 | Smith | 52/233 |
| 4,640,069 | | 2/1987 | Felser . | |
| 4,777,773 | | 10/1988 | Fry . | |
| 4,878,328 | | 11/1989 | Berge . | |
| 4,901,489 | | 2/1990 | Garber . | |
| 4,918,888 | | 4/1990 | Giles et al. . | |
| 4,967,526 | | 11/1990 | Yost . | |
| 5,010,701 | | 4/1991 | Halsey, Jr. et al. . | |
| 5,058,343 | | 10/1991 | Nipko . | |
| 5,103,610 | | 4/1992 | Walters . | |
| 5,115,609 | | 5/1992 | Sing . | |
| 5,163,259 | | 11/1992 | Hunsaker et al. . | |
| 5,181,358 | | 1/1993 | Mead . | |
| 5,265,390 | | 11/1993 | Tanner . | |
| 5,271,878 | | 12/1993 | Mizia et al. . | |
| 5,282,343 | | 2/1994 | Stein . | |
| 5,423,153 | | 6/1995 | Woolems et al. . | |
| 5,577,357 | | 11/1996 | Civelli . | |
| 5,638,649 | * | 6/1997 | Hovland | 52/233 |

* cited by examiner

*Primary Examiner*—Beth A. Stephan
*Assistant Examiner*—Phi Dieu Trawa

(57) ABSTRACT

A log facade. A siding facade member is attached to a wall of the structure and extends to a corner thereof. A side of the siding member is formed as a portion of a semi-cylinder, giving the illusion that the siding member is part of a whole log. A corner member is attached to the corner of the structure and includes a round side surface that simulates the cross-section of a whole log. The siding facade member has an end that is received by the corner member, so as to cover an edge thereof, giving the illusion that the siding facade member is interlocked with the corner member without requiring that the edge be specially shaped to fit the round side surface.

7 Claims, 3 Drawing Sheets

LOG FACADE

BACKGROUND OF THE INVENTION

The present invention relates to an improved log facade, particularly a facade for a conventional structure providing the appearance that the structure is constructed of whole logs.

For a long time, the prior art has addressed the need to provide a facade for a structure, such as a cabin, home, outbuilding, or commercial building, that makes the structure appear as if it were constructed of whole stacked logs without requiring the use of whole logs. Such facades provide for the rustic appearance of stacked log construction more economically, while providing as well for the full enjoyment of modern building methods. Generally, however, facades providing for greater visual similarity with whole logs are more costly. For example, it is generally less expensive to provide for false log ends at the corners of a structure that are not staggered with false log siding applied to the walls of the structure such as shown in Berge, U.S. Pat. No. 4,878,328, and Rupp, U.S. Pat. No. 4,320,610. This is because the cuts made in the components of the facade do not need to be as complex. On the other hand, such construction produces a less convincing imitation of a whole log structure.

Other attempts at simulating the look of a whole log structure have been made in recognition that providing for staggering of the false log ends with the false siding improves the simulation. Such attempts, however, have required more complex shapes to be formed in the components so that the components can fit together, which has resulted in increased manufacturing costs. Moreover, such attempts generally require that the false log siding be specially pre-formed at its ends for interlocking or interfitting with the false log ends, so that cutting the siding at the site generally results in an abundance of wasted material.

Accordingly, there is a need for an improved log facade that provides for an improved degree of visual similarity with a whole log structure while providing for decreased manufacturing and assembly cost.

SUMMARY OF THE INVENTION

An improved log facade according to the present invention solves the aforementioned problems and meets the aforementioned needs by providing, on a structure for which it is desired to simulate the appearance that the structure is constructed of whole logs, a corner facade member and a siding facade member. The siding facade member is attached to the wall of the structure and extends to a corner thereof. Preferably, one side of the siding member is formed as a portion of a semi-cylinder, the curvature of which gives the illusion that the siding member is part of a whole log. The corner facade member is attached to the corner of the structure and includes a curved side surface that projects outwardly with respect to the wall and simulates the outer surface of a whole log. The siding facade member has an end that is received by the corner facade member, the end having an edge. The corner facade member receives the end of the siding facade member so as to cover the edge, to give the illusion that the siding facade member is interlocked with the corner facade member without requiring that the edge be specially shaped to fit the curved side surface.

Therefore, it is a principal object of the present invention to provide a novel and improved log facade.

It is another object of the present invention to provide a log facade that provides for increased visual similarity with a whole log structure.

It is still another object of the present invention to provide a log facade that provides for decreased manufacturing and assembly costs.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
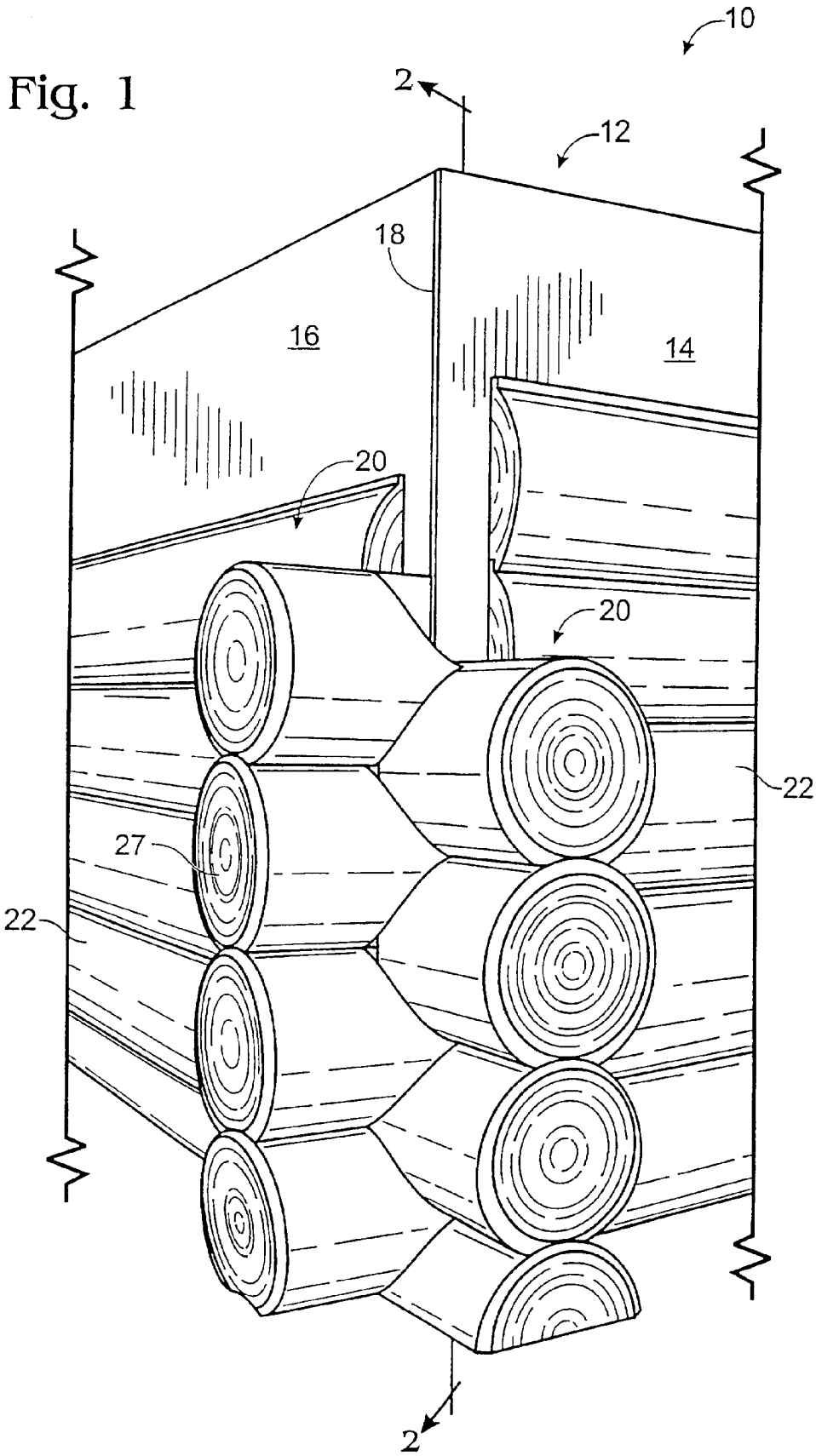
FIG. 1 is a pictorial view of a log facade according to the present invention.

Referring to FIG. 1, a preferred embodiment of an improved log facade 10 according to the present invention is adapted for application to a structure 12 having a left side wall 14 and a right side wall 16 joined to form a corner 18. The structure 12 may be any structure for which it is desired to provide the appearance that the structure is constructed of whole logs. For example, the structure 12 can be constructed of any material, such as wood, masonry or steel, and may incorporate any architectural style. Though reference below will be made to a typical structure 12 employing walls at 90 degree angles, the structure may employ walls at other angles. Typically, the facade 10 is employed to retrofit an existing structure; however, it may be installed in connection with new construction as well.

Figure 2:
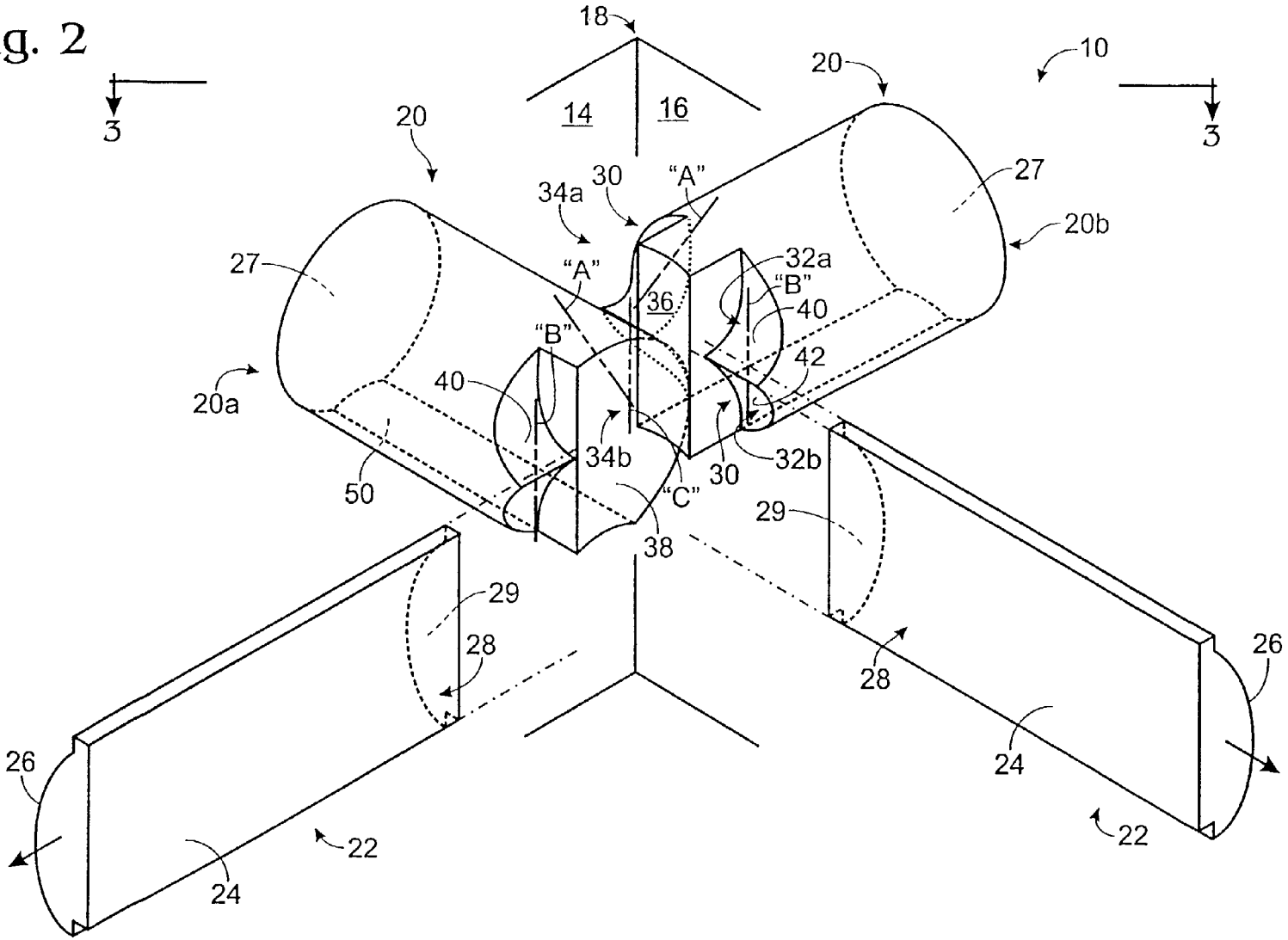
FIG. 2 is a pictorial view of the log facade of FIG. 1 viewed along a line 2—2 thereof
Figure 3:
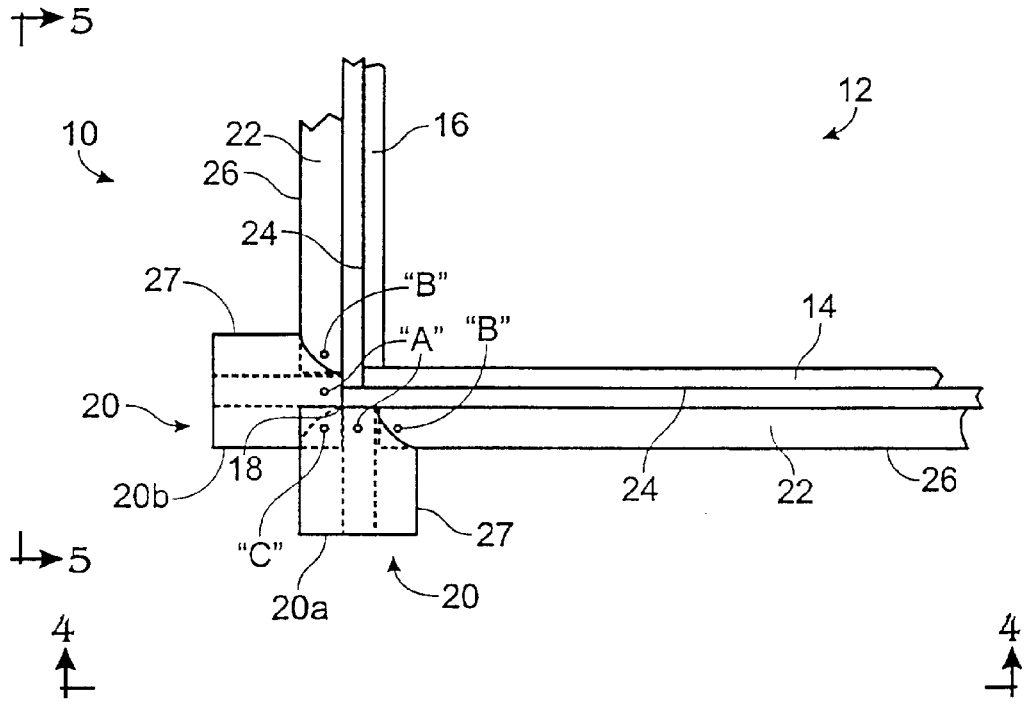
FIG. 3 is a top view of the log facade of FIG. 2 viewed along a line 3—3 thereof

Referring to FIGS. 2 and 3, the facade 10 comprises a plurality of corner members 20 and an associated plurality of siding strips 22. The siding strips 22 are attached to the walls 14 and 16, preferably horizontally for simulating the look of traditional stacked log construction, though the siding strips may be oriented vertically or in some other direction without departing from the principles of the invention.

The siding strips are especially adapted for attachment to the wall at a flat, back-surface 24 of the siding strips. The siding strips may be fastened or held to the walls by suitable fasteners, such as nails, staples of screws, may be bonded to the walls by a suitable adhesive, or may simply be held in place by the corner members 20 as described below.

When a siding strip 22 is placed along the walls, a display surface 26 thereof is visible, having the appearance of the semi-cylindrical or half sectional surface of a whole log. While the siding strips may be formed of whole logs or half sections of logs, it is preferable to form the display surface 26 as a quarter section of a cylinder, which may be accomplished with a planer-molder. It has been found that providing only this much curvature in the siding strips effectively fools the eye into perceiving that the siding strips are the visible portions of whole stacked logs.

Figure 4:
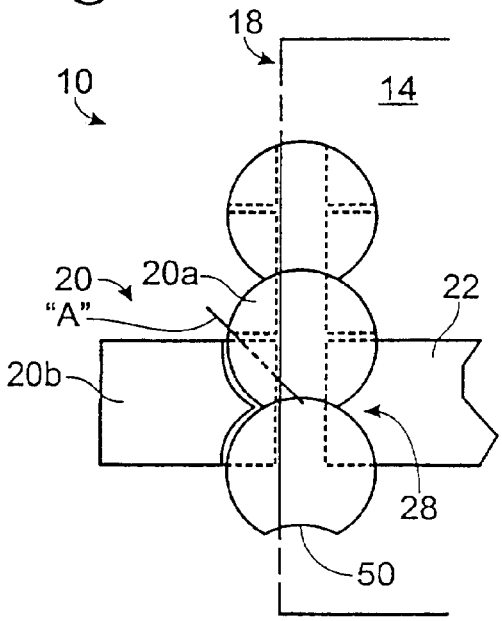
FIG. 4 is a right side view of the log facade of FIG. 3 taken along a line 4—4 thereof
Figure 5:
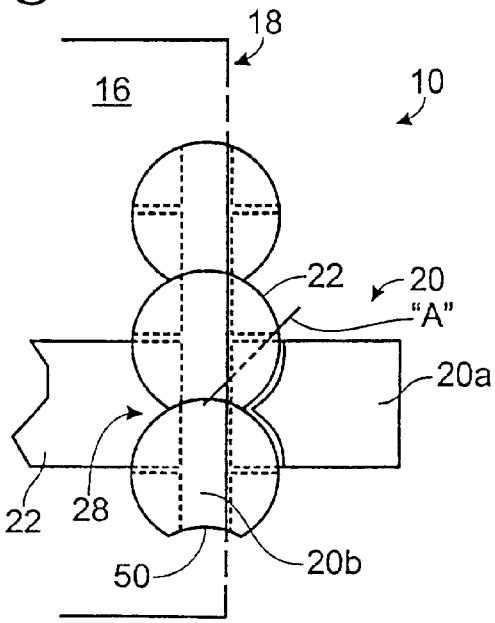
FIG. 5 is a left side view of the log facade of FIG. 3 taken alone a line 5—5 thereof

Referring to FIGS. 4 and 5, the siding strips 22 extend to a position proximate the location of the corner 18 where they are received at ends 28 by some of the corner members 20. The corner members are provided to simulate the visible ends of whole logs.

Two corner members are preferably associated with each siding strip. The siding strips attached to the left side wall 14 are visually associated with corner members 20*a* extending from the right side wall 16, so that it appears that the corner members 20*a* are extensions of the siding strips attached to the left side wall 14, as if the siding strips and the corner members 20*a* are portions of whole logs. On the other hand, the siding strips attached to the left wall 14 are structurally associated with the corner members 20*b* extending from the left wall, which receive the ends of the siding strips as described below.

Similarly, the siding strips attached to the right side wall 16 are visually associated with corner members 20*b* extending from the left side wall 14, and are structurally associated with the corner members 20*a* extending from the right side wall.

As best seen in FIGS. 2 and 3, to simulate the look of whole log ends, the corner members present a generally cylindrical side surface 27, which may be formed on a log lathe. The side surface 27 of the corner member 20*a* projects outwardly with respect to the right side wall 16 and the side surface of the corner member 20*b* projects outwardly with respect to the left side wall 14.

Joining the ends of simulated log siding material to simulated log ends has been a problem in the prior art because of the curvature of the side surface. Typically, the prior art has solved this problem by requiring that the ends of at least some of the siding material be formed with a curvature that matches the curvature of the side surface. This requirement is exemplified in Hovland, U.S. Pat. No. 5,638,649, Kollar et al., U.S. Pat. No. 4,096,674, and the embodiment of FIGS. 6 and 7 of Rupp, U.S. Pat. No. 4,320,610. However, forming the siding material so that it has circular or elliptical shapes at the ends adds complexity to manufacture, and makes it much more difficult to cut the siding at the job site to required dimensions without wasting material.

It is an outstanding feature of the present invention that the ends 28 of the siding strips 22 need not be particularly shaped to conform to the curved side surface of the corner member 20. For example, to realize economy of manufacture as well as to reduce waste at the job site, the ends 28 may be straight cut to form straight edges 29.

Referring back to FIG. 2, the corner members 20 include relief apertures 30 for receiving the ends 28 of the siding strips 22 that are structurally associated therewith. Thence, the structurally associated corner members cover the edges 29 of the ends of the siding strips, so that the edges are not visible. This causes the eye to perceive that the siding strips extend through the structurally associated corner members to the visually associated corner members, as if the siding strips were whole logs.

In concert, the siding strips 22 are staggered with the corner members 20 that extend from the same wall. For example, a siding strip 22 attached to the left side wall 14 is staggered with respect to the adjacent corner member 20*b* extending from the left side wall, and a siding strip 22 attached to the right side wall 16 is staggered with respect to the adjacent corner member 20*a* extending from the right side wall. This effectively gives the illusion that the siding facade strips are interlocked with the corner members as would whole, stacked logs be interlocked in traditional, whole log construction.

To best provide for these appearances, the relief apertures 30 of the corner members 20 are shaped to have substantially half the range of curvature as the siding strips 22, or preferably about an eighth section of a cylinder. For example, longitudinally defined half-sections of two adjacent siding strips 22 are received by the relief apertures 30 of one corner member. The relief apertures may be formed with a radial arm saw employing a dado cutting head.

Each relief aperture, of which there are preferably two in the corner member 20*a* and four in the corner member 20*b*, is located in a quadrant of the corner members 20 as they are viewed in cross-section. Each has an ear 40 defining one side of the relief aperture wherein the corresponding opposite side of the relief aperture is preferably left open as shown. With reference to horizontally applied siding strips 22, preferably, upper and lower relief apertures 32*a* and 32*b* of the corner member 20*b* are spaced apart from upper and lower relief apertures 34*a* and 34*b* of the corner member by a solid portion 36 that abuts the wall 14. A similarly sized portion 38 may be identified in the corner member 20*a* for abutting the wall 16.

The corner members have been described with respect to left and right handedness to dispose a curve receiving portion 50 of the corner members facing downwardly, so that it does not retain moisture. However, otherwise, this designation is arbitrary. For example, the members 20 may be installed upside down from their orientations as shown, wherein the member 20*a* may function as the member 20*b* as shown and vice versa, and the handedness would be reversed.

The invention provides for an improved method for attaching the corner members to the structure 12 and to the siding strips 22 which takes advantage of the structure of the above-described relief apertures 30. In a step of attaching, nails, screws or other suitable fasteners referenced as "A" may be applied through the corner members 20*a* and 20*b* at acute angles into the corner 18. In another step of attaching, nails, screws or other suitable fasteners referenced as "B" may be applied through ears 40 associated with the relief apertures into the siding strips 22. In yet another step of attaching, nails, screws or other suitable fasteners referenced as "C" may be applied through a remaining ear 42 in the corner member 20*a* that is not associated with relief apertures that receive a siding strip 22 and which, instead, receive the corner member 20*b* as shown. The prior art has not heretofore provided for either the second or the third steps of attaching; notwithstanding, the corner members may be attached to the structure 12 or to the siding strips 22 by any steps of attachment or fastening means known in the art without departing from the principles of the invention.

It is to be recognized that, while a specific improved log facade has been shown and described as preferred, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. An ornamental facade for a structure having a first wall and a second wall meeting to define a corner of the structure, comprising:

(a) a first corner member having a substantially cylindrical projection simulating the appearance of a whole log, said first corner member being adapted for attachment to the corner so that said cylindrical projection extends in a direction that is perpendicular to the first wall;

(b) an elongate first wall siding member adapted for placement along the first wall and having a first end, wherein said first corner member including a relief aperture receiving at least a portion of said end; and (c) a second corner member having a substantially cylindrical projection simulating the appearance of a whole log, said second corner member being adapted for attachment to the corner so that said cylindrical projection of said second corner member is in a substantially abutting and parallel relationship to said substantially cylindrical projection of said first corner member said first corner member being elongate and having two ends wherein said relief aperture is located at one of said two ends.

2. The ornamental facade of claim 1, wherein said second corner member is relieved to receive another portion of said end.

3. The ornamental facade of claim 1, wherein said siding member has the shape of about a quarter section of a log.

4. The ornamental facade of claim 1, wherein said relief aperture is open at said one of said two ends.

5. The ornamental facade of claim 1, further comprising a third corner member having a substantially cylindrical projection simulating the appearance of a whole log, said third corner member being adapted for attachment to the corner so that said cylindrical projection of said third corner member extends in a direction that is perpendicular to the second wall, said third corner member being relieved to receive the side of said cylindrical projection of said first corner member and said cylindrical projection of said second corner member.

6. A method for providing an ornamental facade on a structure having a first wall and a second wall meeting to define a corner of the structure, comprising the steps of:

(a) providing a first corner member having a substantially cylindrical projection simulating the appearance of a whole log, said corner member having two ends;

(b) attaching said first corner member to the corner of the structure so that said cylindrical projection extends in a direction that is perpendicular to the first wall;

(c) providing an elongate first wall siding member having a first end;

(d) providing a relief aperture at one of said ends of said first corner member, said relief aperture receiving at least a portion of said end of said first wall siding member;

(e) placing said first wall siding member along the first wall so that said portion of said end of said first wall siding member is received by said first corner member;

(f) providing a second corner member having a substantially cylindrical projection simulating the appearance of a whole log; and (g) attaching said second corner member to the corner so that said cylindrical projection of said second corner member is in substantially abutting and parallel relationship to said cylindrical projection of said first corner member.

7. The method of claim 6, further comprising the steps of providing a second relief aperture on said second corner member so to receive another portion of said end of said first wall siding member and wherein said placing said first wall siding member along the first wall is so that said other portion of said end of said first siding member is received by said second relief aperture.

* * * * *